US011619100B2

(12) United States Patent
Virene

(10) Patent No.: US 11,619,100 B2
(45) Date of Patent: Apr. 4, 2023

(54) EXPANDABLE CUTTING TOOL

(71) Applicant: Smith International, Inc., Houston, TX (US)

(72) Inventor: Patrick Virene, Cypress, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 25 days.

(21) Appl. No.: 17/135,297

(22) Filed: Dec. 28, 2020

(65) Prior Publication Data

US 2021/0198952 A1 Jul. 1, 2021

Related U.S. Application Data

(60) Provisional application No. 62/955,148, filed on Dec. 30, 2019.

(51) Int. Cl.
*E21B 10/32* (2006.01)

(52) U.S. Cl.
CPC ..... *E21B 10/32* (2013.01)

(58) Field of Classification Search
CPC ..... E21B 10/32; E21B 10/62
See application file for complete search history.

(56) References Cited

U.S. PATENT DOCUMENTS

| | | | | |
|---|---|---|---|---|
| 6,070,677 | A * | 6/2000 | Johnston, Jr. | E21B 47/095 175/325.1 |
| 2003/0155155 | A1 | 8/2003 | Dewey et al. | |
| 2011/0073330 | A1* | 3/2011 | Radford | E21B 10/32 166/387 |
| 2014/0262523 | A1* | 9/2014 | Davis | E21B 10/322 175/57 |

* cited by examiner

*Primary Examiner* — Caroline N Butcher

(57) ABSTRACT

An expandable tool includes a cutting block set. The cutting block set includes an upper cutting block and a lower cutting block, arranged longitudinally. The upper cutting block includes upper block splines having an upper block angle. The lower cutting block includes lower block splines having a lower block angle. The upper block angle is greater than the lower block angle, which directs the upper cutting block to extend radially further outward than the lower cutting block.

19 Claims, 8 Drawing Sheets

EXPANDABLE CUTTING TOOL

CROSS-REFERENCE TO RELATED APPLICATIONS

This application claims the benefit of, and priority to, U.S. Patent Application No. 62/955,148 entitled "Expandable Cutting Tool," filed on Dec. 30, 2019, which is incorporated herein by this reference in its entirety.

BACKGROUND OF THE DISCLOSURE

Wellbores may be drilled into a surface location or seabed for a variety of exploratory or extraction purposes. For example, a wellbore may be drilled to access fluids, such as liquid and gaseous hydrocarbons, stored in subterranean formations and to extract the fluids from the formations. Wellbores used to produce or extract fluids may be lined with casing around the walls of the wellbore. A variety of drilling methods may be utilized depending partly on the characteristics of the formation through which the wellbore is drilled. In some situations, an expandable downhole tool may expand the diameter of the wellbore, cut a portion of the casing, or perform any other cutting activity. Some downhole tools may include cutter blocks that may be selectively expanded.

SUMMARY

In some embodiments, an expandable tool includes a cutting block set. The cutting block set includes a first cutting block having a block angle of between 10° and 25°. The cutting block set includes a second cutting block having a block angle of greater than 17°. In some embodiments, the cutting block set is connected with an interlocking connection.

In some embodiments, a method for operating an expandable tool includes expanding a first cutting block of a cutting block set at a first extension ratio of longitudinal movement to radial extension of the first cutting block. A second cutting block expanded at a second extension ratio of longitudinal movement to radial movement of the second cutting block. The first extension ratio is different from the second extension ratio.

This summary is provided to introduce a selection of concepts that are further described in the detailed description. This summary is not intended to identify key or essential features of the claimed subject matter, nor is it intended to be used as an aid in limiting the scope of the claimed subject matter. Additional features and aspects of embodiments of the disclosure will be set forth herein, and in part will be obvious from the description, or may be learned by the practice of such embodiments.

BRIEF DESCRIPTION OF THE DRAWINGS

In order to describe the manner in which the above-recited and other features of the disclosure can be obtained, a more particular description will be rendered by reference to specific embodiments thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example embodiments, the embodiments will be described and explained with additional specificity and detail through the use of the accompanying drawings in which:

FIG. 3-1 is a representation of a cut-away view of a downhole cutting tool in a retracted position, according to at least one embodiment of the present disclosure;

FIG. 3-2 is a representation of a cut-away view of the downhole cutting tool of FIG. 3-1 in an expanded position;

DETAILED DESCRIPTION

This disclosure generally relates to devices, systems, and methods for expandable downhole tools. The expandable tool may include a cutting block set. The cutting block set may include two or more cutting blocks. In some embodiments, the cutting blocks may be longitudinally arranged and immediately adjacent each other. The cutting blocks may be longitudinally movable, and the longitudinal movement may cause the cutting blocks to extend radially. The cutting blocks may be configured to extend radially outward at different rates (e.g., radial to longitudinal movement rate). By extending radially outward at different rates, an upper cutting block may extend radially further than a lower cutting block. This may allow the cutting block set to remove more material (e.g., expand the borehole radially further).

Figure 1:
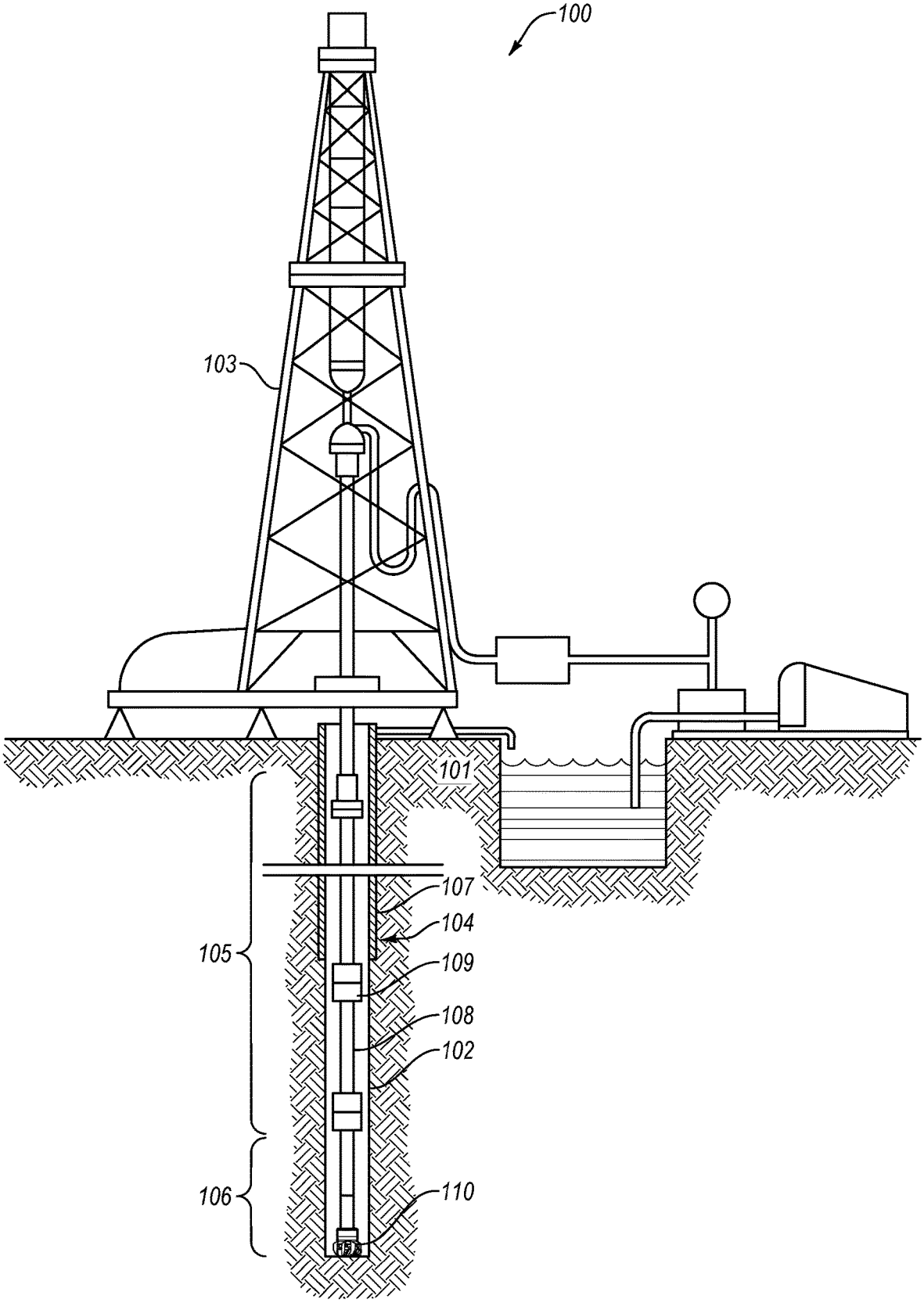
FIG. 1 is a representation of a drilling system, according to at least one embodiment of the present disclosure.

FIG. 1 shows one example of a drilling system 100 for drilling an earth formation 101 to form a wellbore 102. The drilling system 100 includes a drill rig 103 used to turn a drilling tool assembly 104 which extends downward into the wellbore 102. The drilling tool assembly 104 may include a drill string 105, a bottomhole assembly ("BHA") 106, and a bit 110, attached to the downhole end of drill string 105.

The drill string 105 may include several joints of drill pipe 108 connected end-to-end through tool joints 109. The drill string 105 transmits drilling fluid through a central bore and transmits rotational power from the drill rig 103 to the BHA 106. In some embodiments, the drill string 105 may further include additional components such as subs, pup joints, etc. The drill pipe 108 provides a hydraulic passage through which drilling fluid is pumped from the surface. The drilling fluid discharges through selected-size nozzles, jets, or other orifices in the bit 110 for the purposes of cooling the bit 110 and cutting structures thereon, and for lifting cuttings out of the wellbore 102 as it is being drilled.

The BHA 106 may include the bit 110 or other components. An example BHA 106 may include additional or other components (e.g., coupled between the drill string 105 and the bit 110). Examples of additional BHA components include drill collars, stabilizers, measurement-while-drilling ("MWD") tools, logging-while-drilling ("LWD") tools, downhole motors, underreamers, section mills, hydraulic disconnects, jars, vibration or dampening tools, other components, or combinations of the foregoing. The BHA 106 may further include a rotary steerable system (RSS). The RSS may include directional drilling tools that change a direction of the bit 110, and thereby the trajectory of the wellbore. At least a portion of the RSS may maintain a geostationary position relative to an absolute reference frame, such as gravity, magnetic north, and/or true north. Using measurements obtained with the geostationary position, the RSS may locate the bit 110, change the course of the bit 110, and direct the directional drilling tools on a projected trajectory.

In general, the drilling system 100 may include other drilling components and accessories, such as special valves (e.g., kelly cocks, blowout preventers, and safety valves). Additional components included in the drilling system 100 may be considered a part of the drilling tool assembly 104, the drill string 105, or a part of the BHA 106 depending on their locations in the drilling system 100.

The bit 110 in the BHA 106 may be any type of bit suitable for degrading downhole materials. For instance, the bit 110 may be a drill bit suitable for drilling the earth formation 101. Example types of drill bits used for drilling earth formations are fixed-cutter or drag bits. In other embodiments, the bit 110 may be a mill used for removing metal, composite, elastomer, other materials downhole, or combinations thereof. For instance, the bit 110 may be used with a whipstock to mill into casing 107 lining the wellbore 102. The bit 110 may also be a junk mill used to mill away tools, plugs, cement, other materials within the wellbore 102, or combinations thereof. Swarf or other cuttings formed by use of a mill may be lifted to surface or may be allowed to fall downhole.

Figure 2:
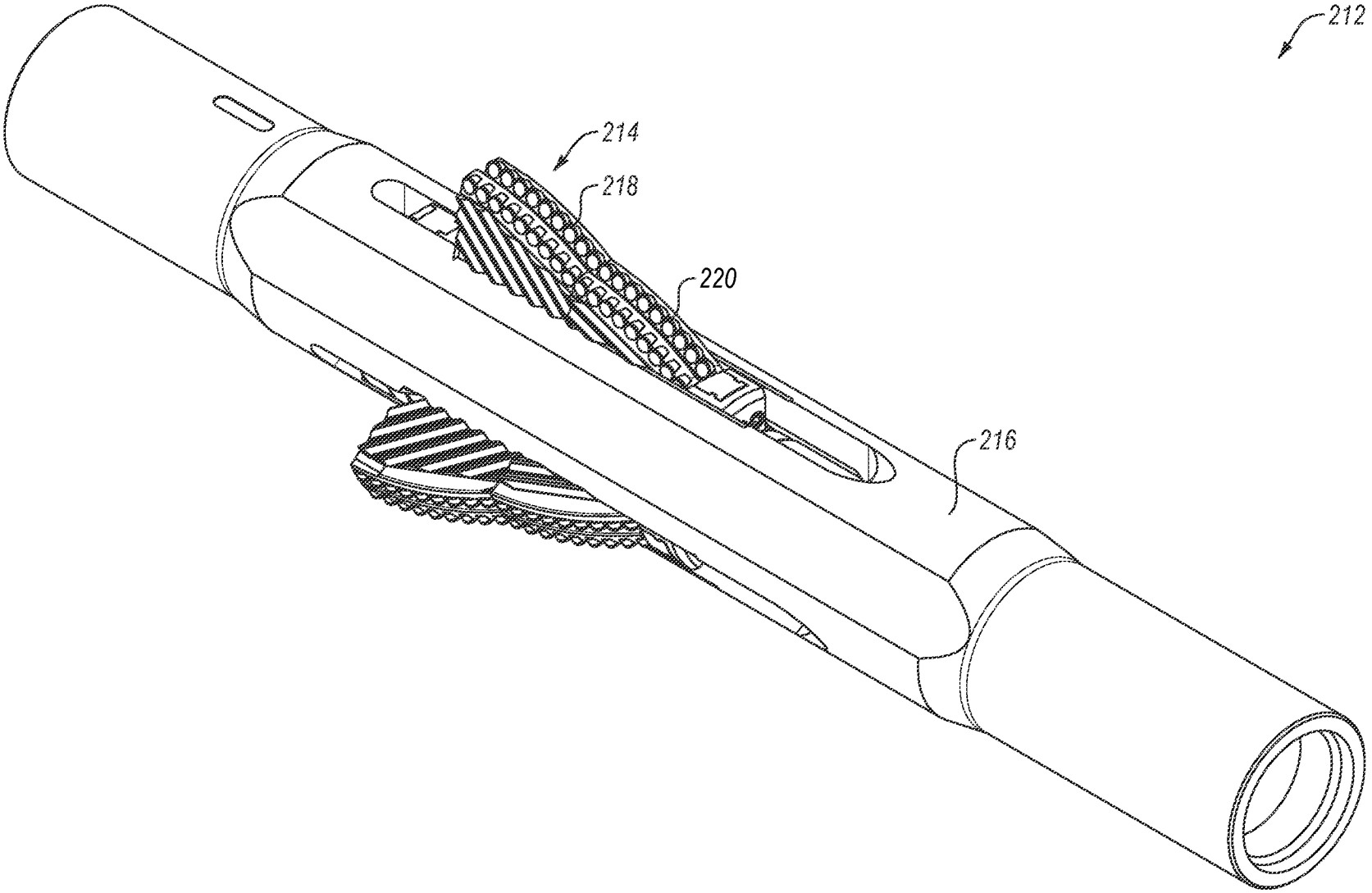
FIG. 2 is a representation of a perspective view of a downhole cutting tool, according to at least one embodiment of the present disclosure.

FIG. 2 is a representation of a perspective view of a downhole cutting tool 212 in an extended position, according to at least one embodiment of the present disclosure. The downhole cutting tool 212 shown is an expandable reamer. In some embodiments, the downhole cutting tool 212 may be any expandable downhole tool. For example, the downhole cutting tool 212 may be a cutting tool, such as a reamer, a casing cutter, a section mill, or any other expandable cutting tool. In some embodiments, the downhole cutting tool 212 may be used while drilling. For example, an expandable reamer may be used while simultaneously drilling a pilot hole. In some embodiments, the downhole cutting tool 212 may be tripped downhole to cut material after a hole has been drilled. For example, the downhole cutting tool 212 may cut a section of a casing, may drill through a packer or a plug, or may ream a wider section of the wellbore.

Upon actuation, a cutting block set 214 may extend through an interior and past an exterior of a housing 216. The cutting block set 214 includes an upper cutting block 218 and a lower cutting block 220, the upper cutting block 218 and the lower cutting block 220 being arranged longitudinally. In other words, the upper cutting block 218 is immediately longitudinally adjacent to the lower cutting block 220. For example, a lower face of the upper cutting block 218 may abut against an upper face of the lower cutting block 220. In some embodiments, an entirety of the upper cutting block 218 may be located uphole of the lower cutting block 220. The upper cutting block 218 is slidably connected to the lower cutting block 220. As the cutting block set 214 is extended, the upper cutting block 218 may extend at a faster rate than the lower cutting block 220. In this manner, the upper cutting block 218 may extend further from the housing 216 than the lower cutting block 220 by sliding along the lower cutting block 220.

It should be understood that the terms such as "upper" and "lower" may be used to show the relative location of the cutting blocks. However, the terms upper and lower may describe the relative location of the cutting blocks not only with respect to a force of gravity, but with respect to the direction of the hole. Thus, when drilling a horizontal or other non-vertical borehole, the term upper may indicate an uphole direction, or closer to the borehole collar. Similarly, the term lower may indicate a downhole direction, or closer to the bit. Thus, the upper cutting block 218 may be located above, with respect to the force of gravity, the lower cutting block 220, and/or the upper cutting block 218 may be located uphole of the lower cutting block 220.

Figures 1, 3:
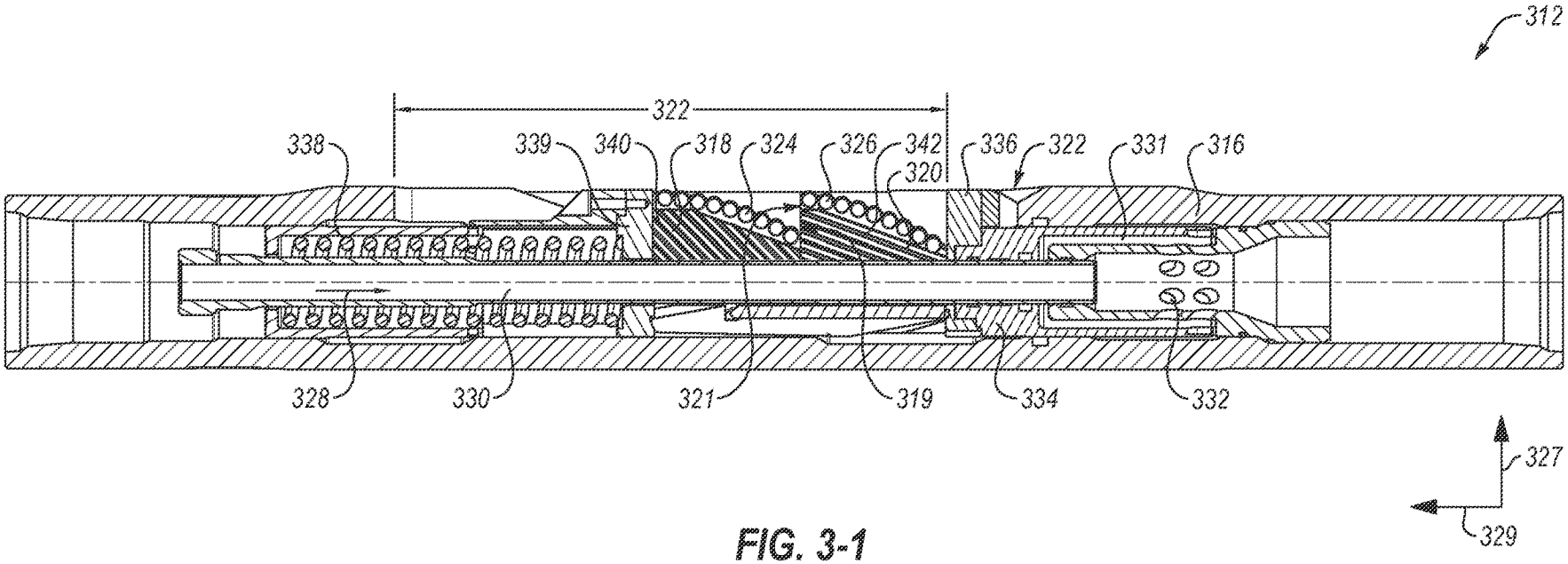
Figures 2, 3:
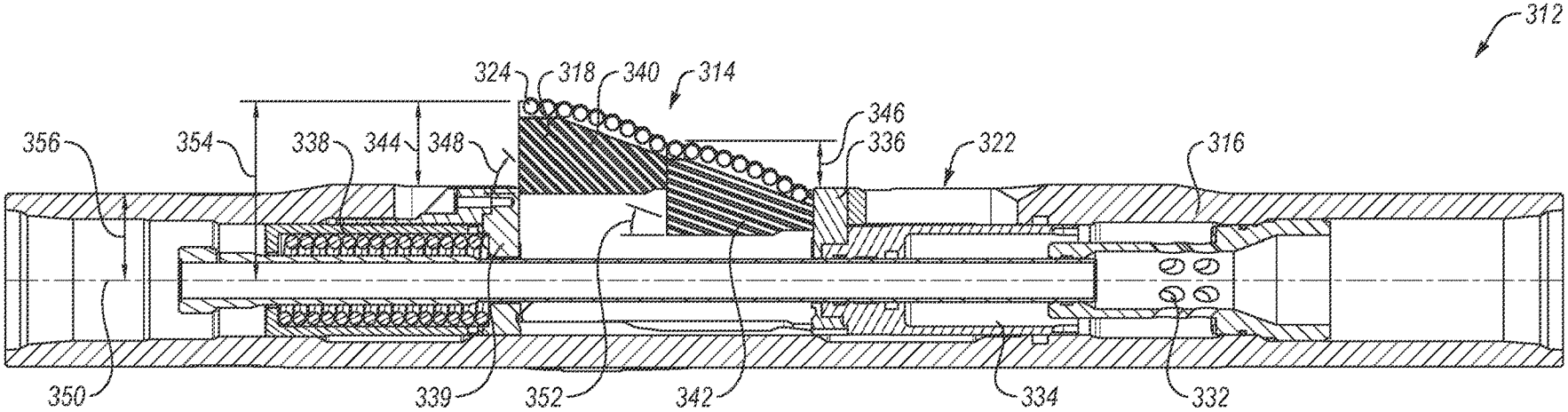

FIG. 3-1 is a cut-away view of a representation of a downhole cutting tool 312, according to at least one embodiment of the disclosure. The downhole cutting tool 312 includes a housing 316 with an opening 322 therein. A cutting block set 314 is configured to be inserted through the opening 322. The cutting block set 314 includes an upper cutting block 318 and a lower cutting block 320. The upper cutting block 318 is arranged longitudinally with the second cutting block 320. In other words, the upper cutting block 318 may be located longitudinally adjacent the lower cutting block 320. For example, the upper cutting block 318 may be located uphole of the lower cutting block 320. A lower end 319 of the upper cutting block 318 may abut, or be immediately adjacent to, an upper end 321 of the lower cutting block 320. The upper cutting block 318 includes a plurality of upper cutting elements 324 and the lower cutting block 320 includes a set of lower cutting elements 326. In some embodiments, all of the upper cutting elements 324 may be uphole of all of the lower cutting elements 326.

A fluid flow 328 may flow through a flow channel 330. The fluid flow 328 may enter a piston chamber 331 through ports 332 in the flow channel 330. Fluid pressure from the fluid flow 328 may push against an extension piston 334 (e.g., in the longitudinal direction 329), which may push on a lower push plate 336. A resilient member 338 (such as a spring) may push on an upper push plate 339 and provide a return force opposite the extension force from the fluid pressure (e.g., opposite the longitudinal direction 329). As the fluid pressure increases, the extension force increases. When the extension force exceeds the return force, the lower push plate 336 may push the cutting block set 314 uphole in the longitudinal direction 329. This may cause the cutting block set 314 to extend out of the opening 322 (e.g., in the radial direction 327) and away from the housing 316.

The upper cutting block 318 includes upper block splines 340. The lower cutting block 320 includes lower block splines 342. The upper block splines 340 engage with housing splines to direct the upper cutting block 318 out of the housing. Similarly, the lower block splines 342 engage with housing splines to direct the lower cutting block 320 out of the housing. The housing splines are located on a wall of the opening 322 of the housing 316. In some embodiments, the upper block splines 340 may be protrusions or rails extending from the side surface of the upper cutting block 318. In some embodiments, the upper block splines 340 may include grooves machined into the upper cutting block 318, with the upper block splines 340 being the remaining material between adjacent grooves. In some embodiments, the upper block splines 340 may be cast into the upper cutting block 318. In some embodiments, the upper block splines 340 may be additively manufactured into the upper cutting block 318.

Similarly, in some embodiments, the lower block splines 342 may be protrusions or rails extending from the side surface of the lower cutting block 320. In some embodiments, the lower block splines 342 may include grooves machined into the lower cutting block 320, with the lower block splines 342 being the remaining material between adjacent grooves. In some embodiments, the lower block splines 342 may be cast into the lower cutting block 320. In some embodiments, the lower block splines 342 may be additively manufactured into the lower cutting block 320.

FIG. 3-2 is a representation of the expandable tool of FIG. 3-1 in an extended position. In the extended position, the lower push plate 336 has pushed the cutting block set 314 longitudinally uphole. The cutting block set 314 has then been extended out of the opening 322 in the housing 316. The upper cutting block 318 may extend out of the housing 316 by an upper extension 344, and the lower cutting block 320 may extend out of the housing 316 by a lower extension 346. In some embodiments, the upper extension 344 may be greater than the lower extension 346. In other words, the upper cutting block 318 may extend out of the housing 316 further than the lower cutting block 320.

The upper block splines 340 have an upper block angle 348 that is transverse (e.g., not parallel) to the longitudinal axis 350. In some embodiments, the upper block angle 348 may be in a range having an upper value, a lower value, or upper and lower values including any of 17°, 18°, 19°, 20°, 21°, 22°, 23°, 24°, 25°, 30°, 31°, 32°, 33°, 34°, 35°, 36°, 37°, 38°, 39°, 40°, 41°, 42°, 43°, 44°, 45°, or any value therebetween. For example, the upper block angle 348 may be greater than 17°. In another example, the upper block angle 348 may be less than 45°. In yet other examples, the upper block angle 348 may be any value in a range between 17° and 45°. In some embodiments, it may be critical that the upper block angle 348 is greater than 30° to extend radially from the housing and increase the extension of the upper cutting block 318.

In some embodiments, the upper cutting block 318 may have a first extension ratio which is the longitudinal movement of the upper cutting block 318 relative to the radial extension (e.g., the upper extension 344) of the upper cutting block 318 (e.g., the longitudinal movement of the upper cutting block 318 divided by the radial extension of the upper cutting block 318). In some embodiments, the first extension ratio may be in a range having an upper value, a lower value, or upper and lower values including any of 0.9, 1.0, 1.1, 1.2, 1.3, 1.4, 1.5, 1.6, 1.7, 1.8, 1.9, 2.0, 2.1, 2.2, 2.3, 2.4, 2.5, 2.6, 2.7, 2.8, 2.9, 3.0, 3.1, 3.2, 3.3, or any value therebetween. For example, the first extension ratio may be greater than 0.9. In another example, the first extension ratio may be less than 3.3. In yet other examples, the first extension ratio may be any value in a range between 0.9 and 3.3. In some embodiments, it may be critical that the first extension ratio is between 1.1 and 1.3 to sufficiently extend the upper cutting block. In some embodiments, the length of the housing 316 may be determined, at least in part, based on the extension ratio. For example, if the upper extension 344 is 8 inches (20.3 cm), and the first extension ratio is 1.3, then the longitudinal movement of the upper cutting block may be 10.4 inches (13.5 cm).

The lower block splines 342 have a lower block angle 352 that is transverse (e.g., not parallel) to the longitudinal axis 350. In some embodiments, the lower block angle 352 may be in a range having an upper value, a lower value, or upper and lower values including any of 10°, 11°, 12°, 13°, 14°, 15°, 16°, 17°, 18°, 19°, 20°, 21°, 22°, 23°, 24°, 25°, or any value therebetween. For example, the lower block angle 352 may be greater than 10°. In another example, the lower block angle 352 may be less than 25°. In yet other examples, the lower block angle 352 may be any value in a range between 10° and 25°. In some embodiments, it may be critical that the lower block angle 352 is between 18° and 22° to radially secure the second block within the housing.

In some embodiments, the lower cutting block 320 may have a second extension ratio which is the longitudinal movement of the lower cutting block relative to the radial extension of the lower cutting block 320 (e.g., the longitudinal movement of the lower cutting block 320 divided by the radial extension of the lower cutting block 320 (e.g., the lower extension 346)). In some embodiments, the second extension ratio may be in a range having an upper value, a lower value, or upper and lower values including any of 2.2, 2.4, 2.6, 2.8, 3.0, 3.2, 3.4, 3.6, 3.8, 4.0, 4.2, 4.4, 4.6, 4.8, 5.0, 5.2, 5.4, 5.6, 5.8, 5.9, or any value therebetween. For example, the second extension ratio may be greater than 2.2. In another example, the second extension ratio may be less than 5.9. In yet other examples, the second extension ratio may be any value in a range between 2.2 and 5.9. In some embodiments, it may be critical that the second extension ratio is between 2.5 and 3.1 to sufficiently extend the lower cutting block 320. In some embodiments, the length of the housing may be determined based on the second extension ratio. For example, if the lower extension 346 is 4 inches (10.2 cm), and the second extension ratio is 2.7, then the longitudinal movement of the lower cutting block may be 11 inches (27.9 cm).

In some embodiments, both the upper cutting block 318 and the lower cutting block 320 may have the same longitudinal movement. If the upper cutting block 318 has a first extension ratio that is different from the second extension ratio of the lower cutting block 320, then the upper extension 344 may be different from the lower extension 346. For example, if the longitudinal movement of the upper cutting block 318 and the lower cutting block is 15 in. (38.1 cm), the first extension ratio is 1.5, and the lower extension ratio is 3.3, then the upper extension 344 may be 10 in. (25.4 cm) and the lower extension 346 may be 4.6 in. (11.6 cm).

In some embodiments, the upper block angle 348 and the lower block angle 352 (collectively block angle) may indicate the extent to which the respective upper cutting block 318 and lower cutting block 320 (collectively cutting block) extend radially outward from the housing 316. For example, a larger block angle may extend the cutting block further from the housing. A smaller block angle may indicate extend the cutting block less far from the housing 316. A smaller block angle may provide resistance to radial removal from the housing 316. In other words, with a smaller block angle, the block splines engage the housing splines, and that engagement may help to retain the cutting block in place. If the cutting block is fixed longitudinally (e.g., through hydraulic actuation pressure), then, with small block angles, the interaction between the block splines and the housing splines may help to retain the cutting block within the housing 316. In some embodiments, a larger block angle may result in a decreased retention force between the housing splines and the block splines, while a smaller block angle may result in an increased retention force between the housing splines and the block angle.

The downhole cutting tool 312 includes an expanded radius 354 and a retracted radius 356. The expanded radius 354 is the radius from the longitudinal axis 350 to the upper cutting elements 324 of the upper cutting block 318 in the expanded position shown in FIG. 3-2. The retracted radius 356 is the larger of the radius to the upper cutting elements 324 in the retracted position shown in FIG. 3-1, or the radius to the outside of the housing 316. The tool ratio is the ratio between the expanded radius 354 retracted radius 356. In some embodiments, the tool ratio may be in a range having an upper value, a lower value, or upper and lower values including any of 1.6, 1.5, 1.4, 1.3, 1.2, 1.1 or any value therebetween. For example, the tool ratio may be greater than 1.1. In another example, the tool ratio may be less than 1.6. In yet other examples, the tool ratio may be any value in a range between 1.1 and 1.6.

Figure 4:
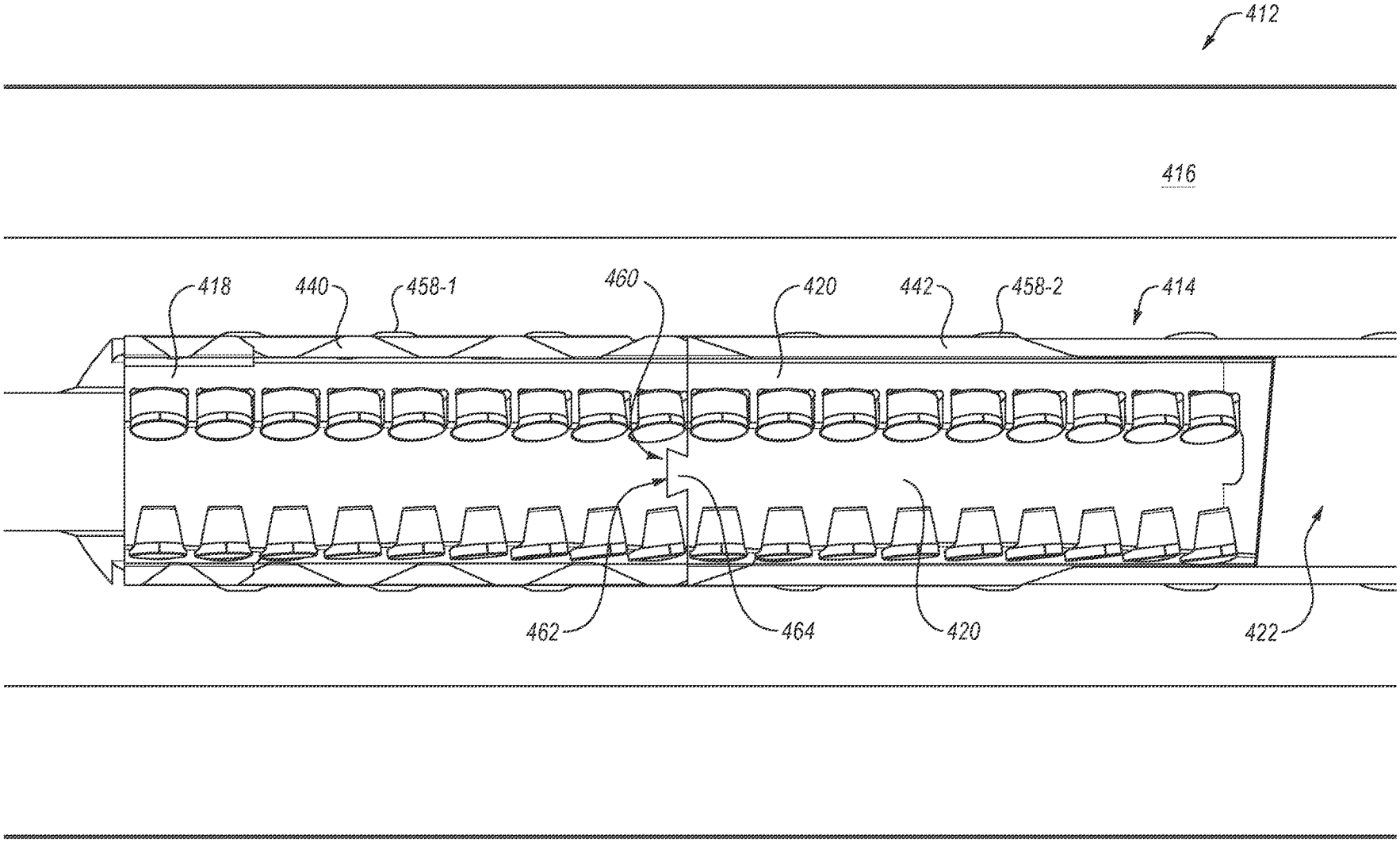
FIG. 4 is a representation of a top-down view of a cutting block set, according to at least one embodiment of the present disclosure.

FIG. 4 is a representation of a top-down view (e.g., toward a longitudinal axis) of a downhole cutting tool 412, according to at least one embodiment of the present disclosure. In the embodiment shown, a cutting block set 414 is shown inside an opening 422 of a housing 416. The cutting block set 414 includes an upper cutting block 418 and a lower cutting block 420. The upper cutting block 418 include upper block splines 440 and the lower cutting block 420 includes lower block splines 442. The housing 416 includes housing splines (collectively 458). The upper block splines 440 engage (e.g., interlock, are directed by) upper housing splines 458-1, and the lower block splines 442 engage (e.g., interlock, are directed by) the lower housing splines 458-2. Thus, as the cutting block set 414 is moved longitudinally (e.g., left to right), the housing splines 458 may remain stationary, and may direct the cutting block set 414 to extend and retract (e.g., into and out of the page).

As discussed above, the upper block splines 440 may have an upper block angle (e.g., upper block angle 348 of FIG. 3-2) that is different from a lower block angle (e.g., lower block angle 352 of FIG. 3-2) of the lower block splines 442. This may cause the upper cutting block 418 to expand outward at a first extension ratio that is different than a second extension ratio of the lower cutting block 420. In some embodiments, to accommodate the difference in the first extension ratio and the second extension ratio, the upper cutting block 418 may radially (e.g., into and out of the page) slide relative to the lower cutting block 420. In other words, the upper cutting block 418 may not be rigidly connected to the lower cutting block 420. This may allow the upper cutting block 418 to extend at a different rate than the lower cutting block 420 without binding against the housing 416 or otherwise extending unevenly.

The upper cutting block 418 may be connected to the lower cutting block 420 with an interlocking connection 460. The interlocking connection 460 may allow the upper cutting block 418 to radially slide relative to the lower cutting block 420. For example, the interlocking connection 460 may prevent longitudinal movement (e.g., uphole and downhole) of the upper cutting block 418 relative to the lower cutting block 420. This may allow the upper cutting block 418 to extend at a greater extension rate than the lower cutting block 420, while retaining the longitudinal position of the upper cutting block 418 relative to the lower cutting block 420. In other words, in the retracted position, the upper cutting block 418 may be located longitudinally adjacent to the lower cutting block 420, and in the extended position, the upper cutting block 418 may be located longitudinally adjacent to the lower cutting block 420.

In the embodiment shown, the interlocking connection 460 is a dovetail connection. For example, the upper cutting block 418 includes a cut-out portion 462 and the lower cutting block 420 includes a protrusion 464. The protrusion 464 is complementarily shaped to the cut-out portion 462. The protrusion 464 may be slid into the cut-out portion 462 during assembly the cutting block set 414. During extension and/or retraction, engagement of the protrusion 464 with the cut-out portion 462 may prevent relative longitudinal movement between the upper cutting block 418 and the lower cutting block 420.

Figure 5:
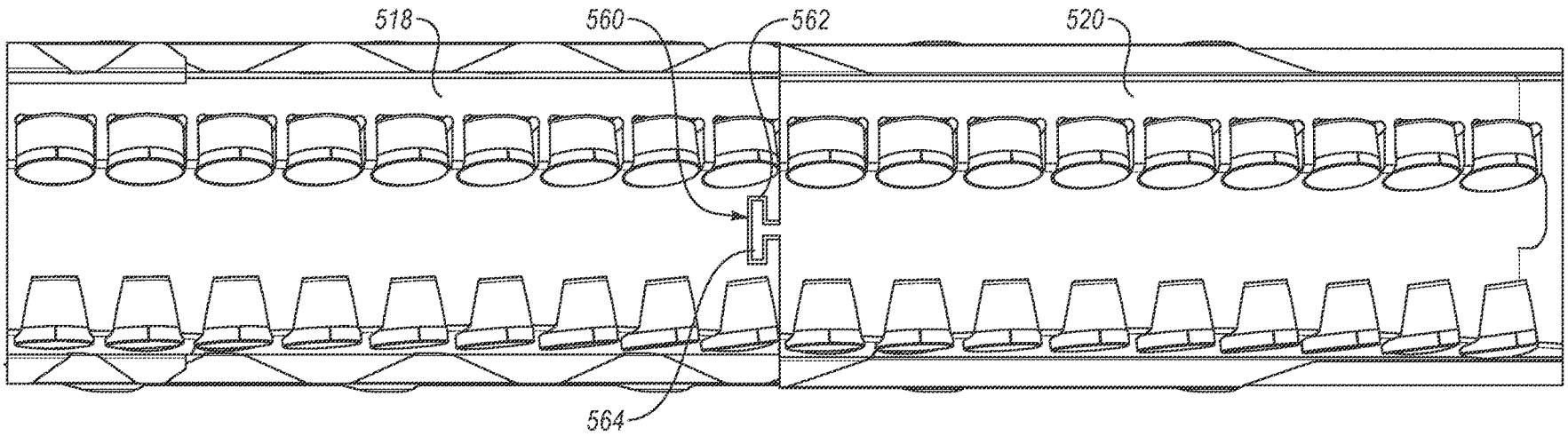
FIG. 5 is representation of another top-down view of a cutting block set, according to at least one embodiment of the present disclosure.

In some embodiments, the interlocking connection 460 may include any type of interlocking connection 460. For example, as shown in FIG. 5 an interlocking connection 560 may include a protrusion 564 that is a bolt threaded into the lower cutting block 520. A bolt head of the protrusion 564 may extend out from the lower cutting block 520 and into the cut-out portion 562. Engagement of the bolt head with the cut-out portion 562 may prevent the upper cutting block 518 from moving longitudinally relative to the lower cutting block 520. In other words, the upper cutting block 518 may be longitudinally fixed relative to the lower cutting block.

Figure 6:
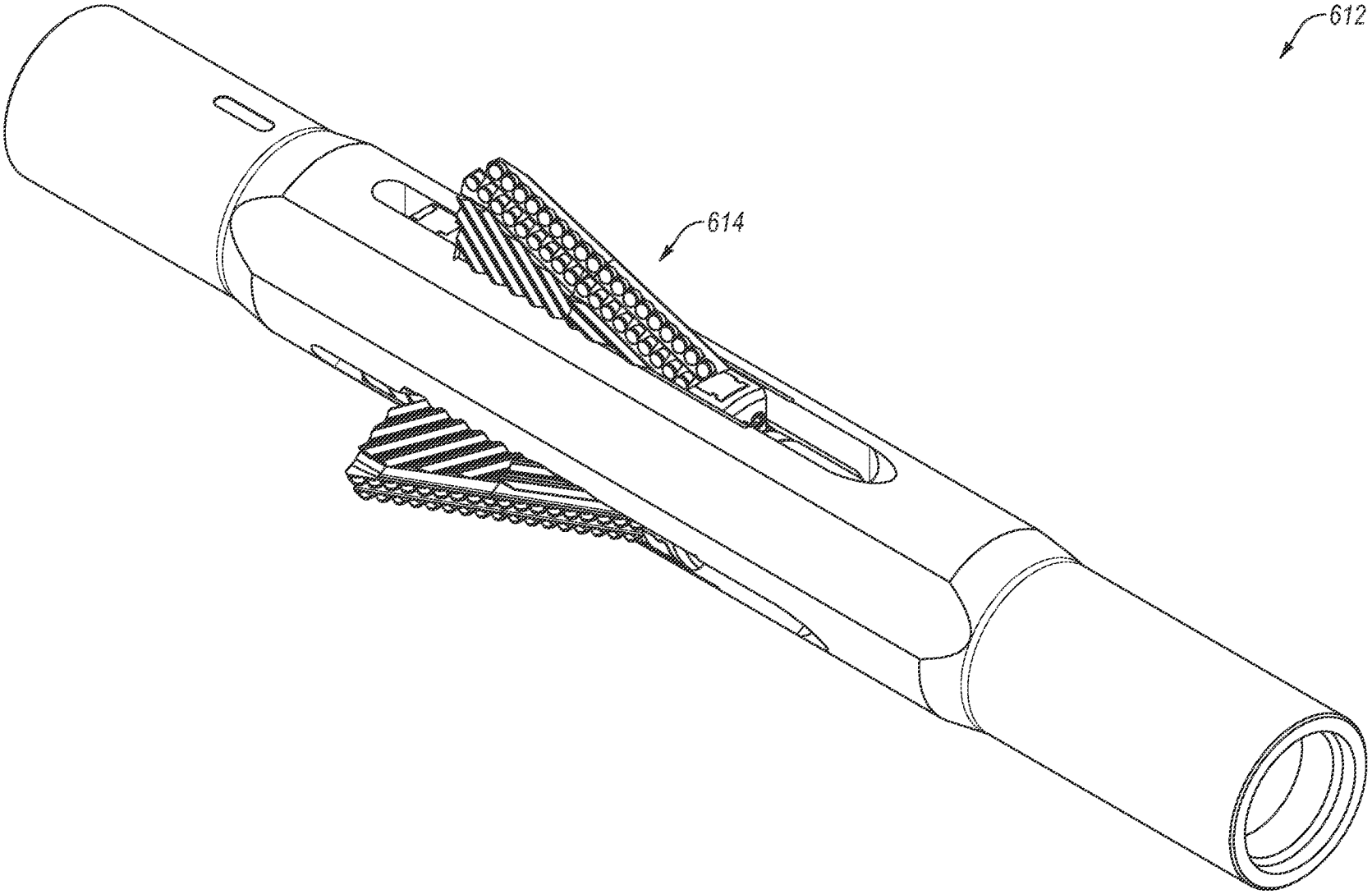
FIG. 6 is a representation of a perspective view of a downhole cutting tool, according to at least one embodiment of the present disclosure.

FIG. 6 is a representation of another downhole cutting tool 612, according to at least one embodiment of the present disclosure. As discussed above, the downhole cutting tool 612 may include any expandable cutting tool. In the embodiment shown in FIG. 6, the downhole cutting tool 612 is an expandable casing cutter shown in an extended position, with the cutter block set 614 being a casing cutter block set. However, it should be understood that the downhole cutting tool 612 may include any expandable downhole tool.

Figure 7:
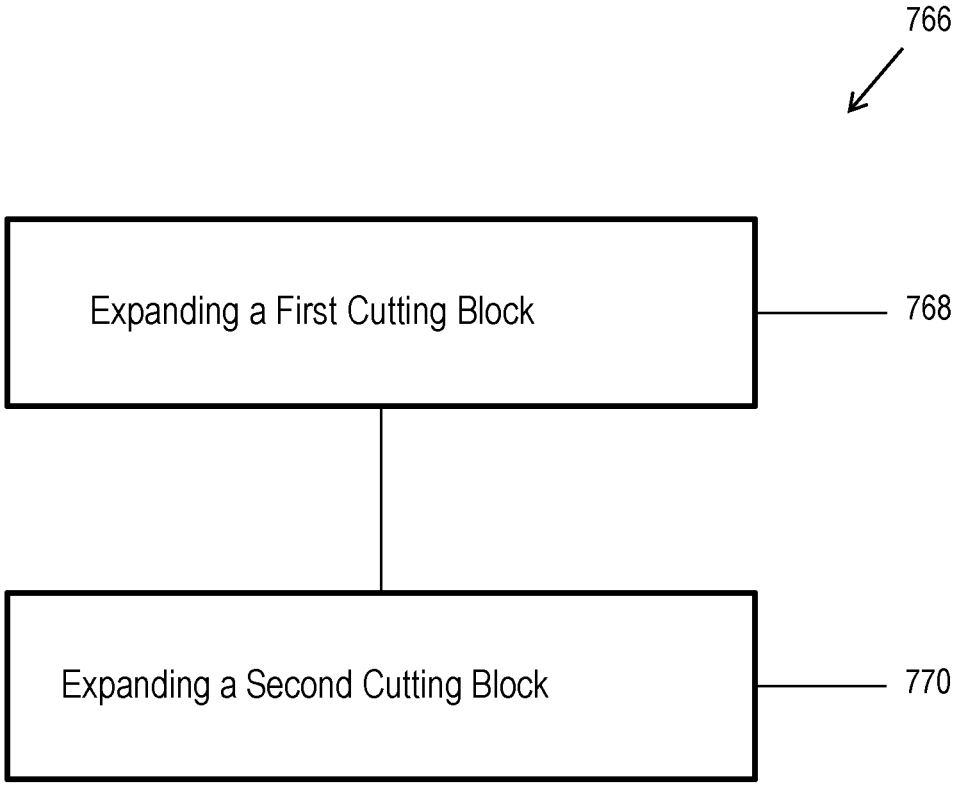
FIG. 7 is a representation of a method for operating a downhole cutting tool, according to at least one embodiment of the present disclosure.

FIG. 7 is a representation of a method 766 for operating a downhole tool, according to at least one embodiment of the present disclosure. The method 766 may include expanding a first cutting block at a first extension ratio at 768. The first extension ratio may be the amount of longitudinal movement relative to the radial extension of the first cutting block. The method 766 may further include expanding a second cutting block with a second extension ratio at 770. The second extension ratio may be the amount of longitudinal movement relative to the radial extension of the second cutting block. The first cutting block and the second cutting block may be arranged longitudinally. In some embodiments, the first extension ratio is different from the second extension ratio.

INDUSTRIAL APPLICABILITY

This disclosure generally relates to devices, systems, and methods for expandable downhole tools. The expandable tool may include a cutting block set. The cutting block set may include two or more cutting blocks. In some embodiments, the cutting blocks may be longitudinally arranged and immediately adjacent each other. The cutting blocks may be longitudinally movable, and the longitudinal movement may cause the cutting blocks to extend radially. The cutting blocks may be configured to extend radially outward at different rates (e.g., radial to longitudinal movement rate). By extending radially outward at different rates, an upper cutting block may extend radially further than a lower cutting block. This may allow the cutting block set to remove more material (e.g., expand the borehole radially further).

In some embodiments, the expandable tool may be any expandable tool. For example, the expandable tool may be a cutting tool, such as a reamer, a casing cutter, a section mill, or any other expandable cutting tool. In some embodiments, the expandable tool may be used while drilling. For example, an expandable reamer may be used while simultaneously drilling a pilot hole. In some embodiments, the expandable tool may be tripped downhole to cut material after a hole has been drilled. For example, the expandable tool may cut a section of a casing, may drill through a packer or a plug, or may ream a wider section of the wellbore. In some embodiments, the expandable tool may be hydraulically actuated. For example, the expandable tool may be actuated by increasing the pressure and/or flow rate of the drilling fluid. In some embodiments, the expandable tool may be electromechanically actuated. In some embodiments, the expandable tool may be actuated using any other actuation mechanism.

In some embodiments, an upper cutting block (e.g., a first cutting block, an uphole cutting block) may be slidably connected to a lower cutting block (e.g., a second cutting block, a downhole cutting block). Thus, as the upper cutting block extends radially faster than the lower cutting block, the upper cutting block may slide radially relative to the lower cutting block, while maintaining contact between the upper cutting block and the lower cutting block. In some embodiments, the upper cutting block may be connected to the lower cutting block with an interlocking connection. Thus, the upper cutting block may slide radially relative to the lower cutting block but may longitudinally fixed relative to the lower cutting block.

In some embodiments, the upper cutting block and the lower cutting block may include one or more block splines (e.g., upper block splines for the upper cutting block and lower block splines for the lower cutting block) on a side surface. In some embodiments, the block splines may be protrusions or rails extending from the side surface of the cutting blocks. In some embodiments, the block splines may include grooves machined into the side surface, with the splines being the remaining material between adjacent grooves. In some embodiments, the block splines may be cast into the cutting blocks. In some embodiments, the block splines may be additively manufactured into the cutting blocks. In some embodiments, the block splines may be arranged at a block angle transverse (e.g., not parallel) to a longitudinal axis of the expandable tool. The splines may interact with housing splines on a housing. Thus, because the block splines are arranged at the block angle, as the cutting blocks move longitudinally, the block splines may contact the housing splines, and the block splines may direct the cutting blocks radially outward and inward.

In some embodiments, the block angle may indicate the extent to which the cutting blocks extend radially outward from the housing. For example, a larger block angle may extend the cutting block further from the housing. A smaller block angle may indicate extend the cutting block less far from the housing. A smaller block angle may provide resistance to radial removal from the housing. In other words, with a smaller block angle, the block splines engage the housing splines, and that engagement may help to retain the cutting block in place. If the cutting block is fixed longitudinally (e.g., through hydraulic actuation pressure), then, with small block angles, the interaction between the block splines and the housing splines may help to retain the cutting block within the housing. In some embodiments, a larger block angle may result in a decreased retention force between the housing splines and the block splines, while a smaller block angle may result in an increased retention force between the housing splines and the block angle.

In some embodiments, the upper cutting block, and the upper block splines may include a, upper block angle and the lower cutting block may include a lower block angle. The upper block angle may be different from the lower block angle. In some embodiments, the upper block angle may be in a range having an upper value, a lower value, or upper and lower values including any of 17°, 18°, 19°, 20°, 21°, 22°, 23°, 24°, 25°, 30°, 31°, 32°, 33°, 34°, 35°, 36°, 37°, 38°, 39°, 40°, 41°, 42°, 43°, 44°, 45°, or any value therebetween. For example, the upper block angle 348 may be greater than 17°. In another example, the upper block angle 348 may be less than 45°. In yet other examples, the upper block angle 348 may be any value in a range between 17° and 45°. In some embodiments, it may be critical that the upper block angle 348 is greater than 30° to extend radially from the housing and increase the extension of the upper cutting block 318.

In some embodiments, the upper cutting block may have a first extension ratio which is the longitudinal movement of the upper cutting block relative to the radial extension of the upper cutting block (e.g., the longitudinal movement of the upper cutting block divided by the radial extension of the upper cutting block). In some embodiments, the first extension ratio may be in a range having an upper value, a lower value, or upper and lower values including any of 0.9, 1.0, 1.1, 1.2, 1.3, 1.4, 1.5, 1.6, 1.7, 1.8, 1.9, 2.0, 2.1, 2.2, 2.3, 2.4, 2.5, 2.6, 2.7, 2.8, 2.9, 3.0, 3.1, 3.2, 3.3, or any value therebetween. For example, the first extension ratio may be greater than 0.9. In another example, the first extension ratio may be less than 3.3. In yet other examples, the first extension ratio may be any value in a range between 0.9 and 3.3. In some embodiments, it may be critical that the first extension ratio is between 1.1 and 1.3 to sufficiently extend the upper cutting block. In some embodiments, the length of the housing may be determined, at least in part, based on the extension ratio. For example, if the upper cutting block is to extend 8 inches (20.3 cm), and the first extension ratio is 1.3, then the longitudinal movement of the upper cutting block may be 10.4 inches (13.5 cm).

In some embodiments, the lower block angle may be in a range having an upper value, a lower value, or upper and lower values including any of 10°, 11°, 12°, 13°, 14°, 15°, 16°, 17°, 18°, 19°, 20°, 21°, 22°, 23°, 24°, 25°, or any value therebetween. For example, the lower block angle 352 may be greater than 10°. In another example, the lower block angle 352 may be less than 25°. In yet other examples, the lower block angle 352 may be any value in a range between 10° and 25°. In some embodiments, it may be critical that the lower block angle 352 is between 18° and 22° to radially secure the second block within the housing.

In some embodiments, the lower cutting block may have a second extension ratio which is the longitudinal movement of the lower cutting block relative to the radial extension of the lower cutting block. In some embodiments, the second extension ratio may be in a range having an upper value, a lower value, or upper and lower values including any of 2.2, 2.4, 2.6, 2.8, 3.0, 3.2, 3.4, 3.6, 3.8, 4.0, 4.2, 4.4, 4.6, 4.8, 5.0, 5.2, 5.4, 5.6, 5.8, 5.9, or any value therebetween. For example, the second extension ratio may be greater than 2.2. In another example, the second extension ratio may be less than 5.9. In yet other examples, the second extension ratio may be any value in a range between 2.2 and 5.9. In some embodiments, it may be critical that the second extension ratio is between 2.5 and 3.1 to sufficiently extend the lower cutting block 320. In some embodiments, the length of the housing may be determined based on the second extension ratio. For example, if the lower cutting block is to extend 4 inches (10.2 cm), and the second extension ratio is 2.7, then the longitudinal movement of the lower cutting block may be 11 inches (27.9 cm).

In some embodiments, both the upper cutting block and the lower cutting block may have the same longitudinal movement. If the upper cutting block has a first extension ratio that is different from the second extension ratio of the lower cutting block, then the upper extension may be different from the lower extension. For example, if the longitudinal movement of the upper cutting block and the lower cutting block is 15 in. (38.1 cm), the first extension ratio is 1.5, and the lower extension ratio is 3.3, then the upper extension 344 may be 10 in. (25.4 cm) and the lower extension 346 may be 4.6 in. (11.6 cm).

In some embodiments, the first and/or lower cutting block may have the same longitudinal movement. Furthermore, the first and/or lower cutting block may have a desired extension amount. To achieve the desired amount of extension in a given longitudinal movement, the first and/or second extension ratio, or the first and/or lower block angle, may be optimized for both the first and/or lower cutting block.

In some embodiments, the upper block angle may be larger than the lower block angle. Thus, when the cutting blocks are moved longitudinally, the upper cutting block may extend further from the housing than the lower cutting block. In some embodiments, the upper cutting block may extend a first extension distance, and the lower cutting block may extend a second extension distance. The block ratio may be the ratio between the first extension distance and the second extension distance. In some embodiments, the tool ratio may be in a range having an upper value, a lower value, or upper and lower values including any of 1.6, 1.5, 1.4, 1.3, 1.2, 1.1 or any value therebetween. For example, the tool ratio may be greater than 1.1. In another example, the tool ratio may be less than 1.6. In yet other examples, the tool ratio may be any value in a range between 1.1 and 1.6.

In some embodiments, the housing splines may be ridges or protrusions on an inner surface of the opening. In some embodiments, the housing splines may have the same angle as the respective upper block splines (e.g., the upper block angle) and the lower block splines (e.g., the lower block angle). For example, the housing splines may include upper housing splines that match the upper block angle and lower housing splines that match the lower block angle. In some embodiments, the housing splines may be perpendicular to the longitudinal axis of the downhole tool. In some embodiments, the housing splines may have no angle, but may be generally square or circular in cross-section.

In some embodiments, the upper cutting block may be connected to the lower cutting block with an interlocking connection. For example, the upper cutting block may be able to slide radially with respect to the lower cutting block but may remain longitudinally fixed relative to the lower cutting block. In some embodiments, the upper cutting block may be connected to the lower cutting block with a dovetail connection. For example, the upper cutting block may include a cut-out portion, including one or more rails. The lower cutting block may include a protrusion complementarily shaped to the cut-out portion. The protrusion may be slid into the cut-out portion, and the engagement of the protrusion with the rails may prevent the upper cutting block from moving longitudinally relative to the lower cutting block. In some embodiments, the upper cutting block may include the protrusion and the lower cutting block may include the cut-out portion.

In some embodiments, the protrusion may be integrally formed within the upper cutting block. In some embodiment, the protrusion may be connected to the upper cutting block after the upper cutting block has been assembled. For example, the protrusion may include a bolt threaded into the upper cutting block. The bolt head may extend out from the upper cutting block and into the cut-out portion. Engagement of the bolt head with the cut-out portion may prevent the upper cutting block from moving longitudinally relative to the lower cutting block. In some examples, the protrusion may be welded and/or brazed onto the upper cutting block. In some embodiments, a radially outer end of the cut-out portion may be closed off. In this manner, the lower cutting block may prevent the upper cutting block from over-extending and being removed from the housing.

In some embodiments, as the cutting block set cuts, the upper cutting block may experience a larger torque than the lower cutting block. This may be due to the upper cutting block extending further than the housing than the lower cutting block. In some embodiments, the interlocking connection of the upper cutting block and the lower cutting block may laterally support the upper cutting block while the cutting block set is cutting. Because the lower cutting block has a lower block angle than the upper cutting block, the lower cutting block may be more securely connected to the housing and may be more resistant to lateral forces and/or motion than the upper cutting block. Thus, by transferring at least a portion of the torque from the upper cutting block to the lower cutting block, the cutting block set may remain securely or more securely connected to the housing.

Conventional cutting tools may have a plurality of cutters arranged longitudinally from downhole to uphole. During a cutting operation, such as reaming, the downhole cutting elements may experience the highest amount of loading. This may be because the downhole cutting elements contact and erode the formation (or casing) first, the downhole cutting elements may erode more material than the uphole cutting elements, the downhole cutting elements support a greater portion of the downhole force applied to the cutting tool, and combinations thereof. In some embodiments, an upper cutting block that extends further from the housing may experience a greater proportion of the total loading than conventional uphole cutting elements. This may be because the cutting elements on the upper cutting block may engage the formation first at the upper, expanded radius of the cutting tool. Thus, the cutting elements on the upper cutting block may support at least a portion of the downhole force exerted on the cutting tool. Thus, in at least one embodiment, an expandable cutting tool according to embodiments of the present disclosure may help to distribute cutter loading between the cutting elements on the upper cutting block and the cutting elements on the lower cutting block.

In some embodiments, a method for operating a downhole tool includes expanding a first cutting block at a first extension ratio. The first extension ratio may be the amount of longitudinal movement relative to the radial extension of the first cutting block. The method may further include expanding a second cutting block with a second extension ratio. The second extension ratio may be the amount of longitudinal movement relative to the radial extension of the second cutting block. The first cutting block and the second cutting block may be arranged longitudinally. In some embodiments, the first extension ratio is different from the second extension ratio.

The embodiments of the downhole tool have been primarily described with reference to wellbore drilling operations; the downhole tool described herein may be used in applications other than the drilling of a wellbore. In other embodiments, downhole tool according to the present disclosure may be used outside a wellbore or other downhole environment used for the exploration or production of natural resources. For instance, downhole tool of the present disclosure may be used in a borehole used for placement of utility lines. Accordingly, the terms "wellbore," "borehole" and the like should not be interpreted to limit tools, systems, assemblies, or methods of the present disclosure to any particular industry, field, or environment.

One or more specific embodiments of the present disclosure are described herein. These described embodiments are examples of the presently disclosed techniques. Additionally, in an effort to provide a concise description of these embodiments, not all features of an actual embodiment may be described in the specification. It should be appreciated that in the development of any such actual implementation, as in any engineering or design project, numerous embodiment-specific decisions will be made to achieve the developers' specific goals, such as compliance with system-related and business-related constraints, which may vary from one embodiment to another. Moreover, it should be appreciated that such a development effort might be complex and time consuming, but would nevertheless be a routine undertaking of design, fabrication, and manufacture for those of ordinary skill having the benefit of this disclosure.

Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that is within standard manufacturing or process tolerances, or which still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. An expandable tool, comprising:

a housing comprising an opening from an interior of the housing to an exterior of the housing, the opening comprising a first housing spline and a second housing spline; and a cutting block set, including:

a first cutting block, the first cutting block including a first block angle of between 10° and 25°; and a second cutting block, the first cutting block and the second cutting block being arranged longitudinally, the second cutting block including a second block angle of greater than 17°;

wherein the first cutting block and the second cutting block are configured to extend through the opening, the first housing spline being configured to direct the first cutting block, and the second housing spline being configured to direct the second cutting block.

2. The expandable tool of claim 1, wherein the cutting block set is a first cutting block set of a plurality of cutting block sets.

3. The expandable tool of claim 1, the first cutting block including a first block spline, the first block spline being transverse to a longitudinal axis of the expandable tool with the first block angle, the second cutting block including a second block spline, the second block spline being transverse to the longitudinal axis with the second block angle.

4. The expandable tool of claim 3, wherein the first block spline engages the first housing spline, and the second block spline engages the second housing spline.

5. The expandable tool of claim 1, wherein the second cutting block is configured to slide radially relative to the first cutting block.

6. The expandable tool of claim 1, wherein in an expanded position, the second cutting block extends further from a housing than the first cutting block.

7. The expandable tool of claim 1, wherein the first cutting block is slidably connected to the second cutting block.

8. The expandable tool of claim 1, wherein the first cutting block is longitudinally fixed relative to the second cutting block.

9. The expandable tool of claim 1, wherein a block ratio between a second extension distance of the second cutting block from an exterior of the housing and a first extension distance of the first cutter block is greater than 1.8.

10. An expandable tool, comprising:

a cutting block set, including:

a first cutting block comprising a first face at a first longitudinal end; and a second cutting block comprising a second face at a second longitudinal end, the first cutting block and the second cutting block being arranged longitudinally with a portion of the first face abutting against another portion of the second face, the first cutting block being connected to the second cutting block with an interlocking connection, wherein the first cutting block is radially movable relative to the second cutting block.

11. The expandable tool of claim 10, wherein the interlocking connection is a dovetail connection.

12. The expandable tool of claim 10, wherein the first cutting block is longitudinally fixed relative to the second cutting block.

13. The expandable tool of claim 10, wherein the interlocking connection prevents the first cutting block from moving longitudinally relative to the second cutting block.

14. A method for operating an expandable tool, comprising:

expanding a first cutting block of a cutting block set at a first extension ratio of longitudinal movement to radial extension of the first cutting block; and expanding a second cutting block of the cutting set at a second extension ratio of longitudinal movement to radial extension of the second cutting block, the second extension ratio being different from the first extension ratio, wherein the first cutting block and the second cutting block are arranged longitudinally with the first cutting block longitudinally fixed relative to the second cutting block.

15. The method of claim 14, wherein a tool ratio between an expanded radius of the first cutting block and a retracted radius of the first cutting block is between 1.1 and 1.6.

16. The method of claim 14, wherein the first extension ratio is between 1.1 and 1.3.

17. The method of claim 14, wherein the second extension ratio is greater than 2.1.

18. The method of claim 14, wherein a block ratio between a first extension distance of the first cutting block and a second extension distance of the second cutting block is greater than 1.8.

19. The method of claim 14, wherein a tool ratio between an expanded radius of the second cutting block and a retracted radius of the second cutting block is greater than 2.0.

* * * * *